United States Patent [19]

Kunick

[11] Patent Number: 4,754,973

[45] Date of Patent: Jul. 5, 1988

[54] FLOOR HOCKEY PUCK

[76] Inventor: Paul Kunick, 1884 Bannatyne Ave. W., Winnipeg, Manitoba, Canada, R2R 0B3

[21] Appl. No.: 861,728

[22] Filed: May 12, 1986

[51] Int. Cl.[4] ..... A63B 67/00

[52] U.S. Cl. ..... 273/128 R

[58] Field of Search ..... 273/128 R, 1 B, 137 AE, 273/424; 401/197; 24/92, 90 C; 29/4, 90 R; 49/475, 490

[56] References Cited

U.S. PATENT DOCUMENTS

| | | | |
|---|---|---|---|
| 3,026,110 | 3/1962 | Hess et al. | 273/424 |
| 3,179,412 | 4/1965 | Neiderberger | 273/424 |
| 3,624,964 | 12/1971 | Bordner et al. | 49/475 |
| 3,704,891 | 12/1972 | Chiarelli | 273/128 R |
| 4,153,253 | 5/1979 | White, Sr. | 273/128 R |
| 4,183,536 | 1/1980 | Platt | 273/128 R |
| 4,253,672 | 3/1981 | Milzoff | 273/424 |
| 4,509,999 | 4/1985 | Sandor | 49/475 |

FOREIGN PATENT DOCUMENTS

| | | | |
|---|---|---|---|
| 403267 | 5/1909 | France | 49/475 |
| 486162 | 5/1938 | United Kingdom | 49/475 |
| 825867 | 12/1959 | United Kingdom | 49/475 |

*Primary Examiner*—Richard C. Pinkham
*Assistant Examiner*—T. Brown
*Attorney, Agent, or Firm*—Adrian D. Battison; Stanley G. Ade

[57] ABSTRACT

A floor hockey puck is formed of two separate materials, the first being harder, less compressible and more dense than the second so as to provide mass and strength to the puck. The second material is softer and more resilient than the first so as to provide the resilience necessary for the proper handle of the puck and also to reduce bodily harm on contact with players. The two separate materials may be arranged in layers through the body of the puck.

3 Claims, 1 Drawing Sheet

FLOOR HOCKEY PUCK

BACKGROUND OF THE INVENTION

This invention relates to a floor hockey puck. It is well known that such pucks comprise a disc generally of about three inches diameter and one inch in height with edges that can be bevelled to a slight extent sufficient to reduce rolling of the puck on the floor and to help the puck lie flat as it travels across the floor. The definition of puck referred to herein is intended to comprise merely disc-shaped objects of this general type and to exclude such other projectiles as balls, rings and the like.

Floor hockey attempts to simulate ice hockey while providing a sport which is less injurious to health. Thus, the puck itself must be designed so that its movement on a suitable floor simulates movement of the ice hockey puck on ice. Thus, it has a number of specific requirements which the ideal puck should meet in order to make it satisfactory for use in a floor hockey game. Specifically, therefore, the puck should provide the following properties:

1. It should have a low co-efficient of restitution so that it is resistant to bouncing on the floor surface.
2. It should have enough weight to allow the puck when shot, to move in a straight path rather than "float", (causing the puck to dip or curve). A mass of 75 to 85 grams has been found suitable for this purpose.
3. It should be resistant to damage caused by compression or stress by contact with one or more hockey sticks, the floor and feet of the players.
4. It should have the correct degree of resilience to enable it to be moved under control of the stick of a player including that it must be sufficiently hard to allow for a "crisp" shot.
5. When used for children or merely for recreational purposes, it should be soft enough to avoid bodily harm when contacting a player at the considerable velocity developed in shooting. For use with a more vigorous game, this requirement may be sacrificed to produce a puck which is more suitable for shooting and handling.
6. The flat surfaces of the puck must be such that it can slide smoothly across a smooth floor surface.

Conventionally, pucks are manufactured by moulding from a resilient material such as hard plastics or rubber, but these have failed enough of the requirements stated above for floor hockey to become accepted widely as a sport.

SUMMARY OF THE INVENTION

It is one object of the invention therefore to provide a floor hockey puck manufactured in a manner which enables it to satisfy many of the above characteristics.

According to the invention therefore there is provided a floor hockey puck formed contiguously from at least two distinct portions wherein at least one of the portions is formed of a first material and at least one of the portions is formed of a second material having different physical properties from the first.

It is one advantage of the present invention that it can be formed of a first dense incompressible material which provides the mass and smooth sliding characteristics and a second softer resilient material which can be used to provide the resilience of the puck to avoid or reduce bodily harm on contact.

It is a second advantage of the invention that it can be formed from two strips of material, the first strip being formed of a hard dense incompressible material and the second strip being formed of a softer more resilient material with the strips together being rolled coaxially of the axis of the puck.

It is a yet further advantage of the invention that it can be formed of flat plates of the material so that the harder material forms the flat surface of the puck sandwiching an inner layer of the softer resilient material.

It is a yet further advantage of the invention that the second resilient material can be formed from a fibrous textile material.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Generally, the invention relates to a puck manufactured from two different materials so that the materials remain distinct in the finished object. This is different from a moulding or casting process wherein the two materials merge so that they become indistinguishable in the finished puck so that their physical properties merge.

One of the materials is generally of a hard or incompressible material which provides properties of high density, high resistance to wear, low co-efficient of friction relative to the floor surface, and generally of a substantially incompressible nature. Hard plastics material can provide suitable properties for the hard material portion of the puck; in addition, such materials as canvas, thin leather, leatherette, vinyl-fibreglass combination, non-elastic rubber, compressed felt and vinyl plastic can be satisfactory.

The other material, in comparison with the first material, provides properties of softness and flexibility so that it can have less density, more compressibility, more resilience than the first material. Examples of such soft materials can be provided by any fibrous textile material including felt, wool, Velcro (registered trade mark) which provide a soft material texture giving resilience to the finished puck which provides the properties defined above and particularly reduces the possibility of bodily harm on contact with a fast moving puck.

The hard material thus is of such a density relative to the soft material that its purpose is to add mass and body to the puck. The soft material in contrast is of such a density and flexibility relative to the hard material that its purpose is to make the puck flexible to contrast the hardness of the first material and to balance out the puck.

Figure 1:
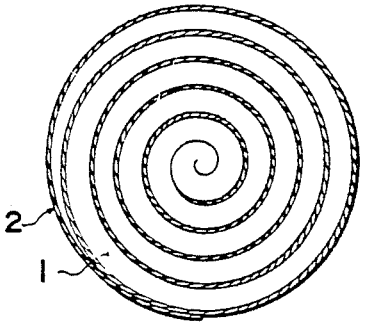
FIG. 1 shows a top plan view of a hockey puck.
Figure 2:
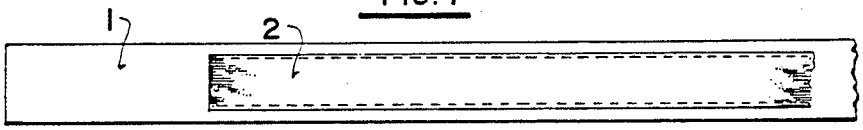
FIG. 2 shows a side elevational view of parts of the puck prior to completion.

Turning now to the drawings, FIG. 1 shows a preferred embodiment of the puck which is formed from the construction of FIG. 2. Specifically, the puck is formed from a strip 1 of felt material which is flexible, resilient, compressible, and of relatively low density connected to a strip of canvas which, in comparison, is less compressible, less resilient, more dense and more resistant to wear. The two strips as shown in FIG. 2 are connected together by stitching. The felt strip is wider than the canvas strip so that it has edges overlapping the canvas strip and one end of several inches extending beyond the adjacent end of the canvas strip.

As shown in FIG. 1, the puck is formed by rolling the strip of FIG. 2 about the axis of the puck with the free portion of felt rolled at the middle of the puck to form a felt core. The strip is rolled in the direction such that the canvas forms the outermost layer of the puck with an end of the canvas extending beyond the adjacent end of the felt to secure the outside layer. The rolled strip is then secured by stitching or binding so that the centre does not lift out of the plane of the puck and so that the exterior end is securely retained. Such securement can be obtained by glueing, sewing, stapling, tying or binding, fusing the materials together by heat or by the use of mechanical connectors such as hooks or staples.

In an alternative arrangement, two canvas strips are attached to respective sides of the felt strip with one of the canvas strips extending beyond the other strip, to be rolled into a core of the puck.

To provide a heavier, less resistant puck more suitable for a more vigorous game where skill and accuracy are more important than injury, the central core of the puck of FIG. 1 or the above described alternative can be hardened by the application of a settable liquid such as a thermoplastic resin or shellac.

To allow the puck to be used outside, it should be rendered resistant to water by a coating on or impregnation of the textile materials since freezing of any water within the puck would affect its weight and resilience characteristics.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A floor hockey puck comprising a disc-shaped body having planar parallel circular end faces and a cylindrical peripheral wall, the end faces having a diameter and the peripheral wall having a height, said body being formed of strips of a first and a second flexible strip material connected together by stitching in parallel overlying relationship to form a strip having a width equal to the wall height, the strip being rolled spirally with each spiral turn in contact with and attached to a next adjacent spiral turn to a diameter equal to said end fade diameter, said first strip material being felt and said second strip material being a fabric, said fabric strip having an end thereof at the outermost spiral turn extending beyond the adjacent end of the felt strip.

2. A puck according to claim 1 wherein the second strip material is canvas.

3. A puck according to claim 1 wherein the strip of the first strip material is wider than the strip of the second strip material.

* * * * *